United States Patent [19]

Holvoet et al.

[11] 4,375,055

[45] Feb. 22, 1983

[54] DEVICE FOR ARTICULATING A MOVING BLADE PIVOTING ON ITS BASE AND A SWITCH WHICH COMPRISES SUCH A DEVICE

[75] Inventors: Gérard Holvoet; Jacques Legrand, both of Quai Léon Blum, France

[73] Assignee: Socapex, France

[21] Appl. No.: 245,173

[22] Filed: Mar. 18, 1981

[30] Foreign Application Priority Data

Mar. 26, 1980 [FR] France ..... 80 06688

[51] Int. Cl.[3] ..... H01H 1/08

[52] U.S. Cl. ..... 335/56; 200/182; 200/234; 200/235; 200/81.6; 200/84 C

[58] Field of Search ..... 200/182, 233, 234, 235, 200/236, 244, 245, 81.6, 84 C; 335/47, 48, 49, 50, 51, 52, 53, 54, 55, 56, 57, 58

[56] References Cited

U.S. PATENT DOCUMENTS

| | | | |
|---|---|---|---|
| 2,295,602 | 9/1942 | Pollard | 335/52 |
| 2,317,695 | 4/1943 | Pollard | 335/56 |
| 2,923,792 | 2/1960 | Fry | 335/56 |
| 3,470,502 | 9/1969 | Koda et al. | 335/47 |
| 3,531,743 | 9/1970 | Frydman | 335/48 |

FOREIGN PATENT DOCUMENTS

| | | |
|---|---|---|
| 1514762 | 5/1969 | Fed. Rep. of Germany . |
| 1764884 | 11/1971 | Fed. Rep. of Germany . |
| 2106321 | 9/1972 | Fed. Rep. of Germany . |
| 2326338 | 12/1974 | Fed. Rep. of Germany . |
| 2392485 | 12/1978 | France . |

*Primary Examiner*—John W. Shepperd

[57] ABSTRACT

The invention relates to a device for articulating a moving blade pivoting on its base.

The mobile member is constituted by a blade fixed to a float, which floats on a liquid contained in a cavity made in a base, the liquid being kept in the cavity by capillarity. The nature and dimensions of the float are adapted to the liquid density. The cavity dimensions are large enough to permit the float to move, without mechanical jamming. The mobile assembly, blade and float is prevented from escaping from the cavity by at least one bridge welded to the base towards the ends of the float.

Application to switches with blades wetted by an electricity-conducting liquid.

11 Claims, 6 Drawing Figures

FIG. 1
PRIOR ART
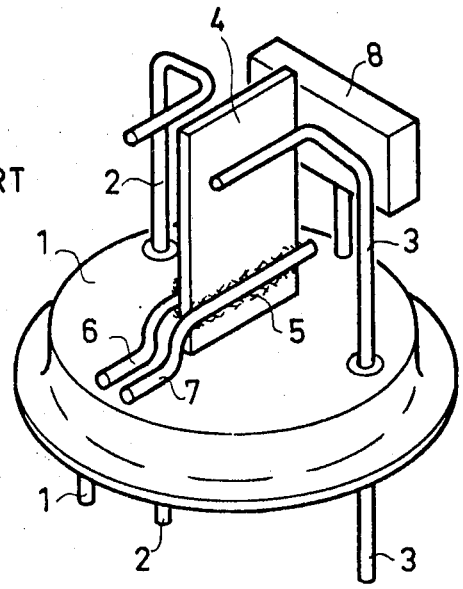
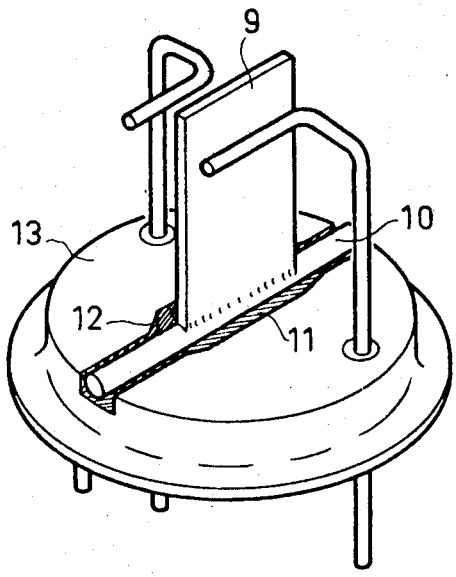
FIG. 2
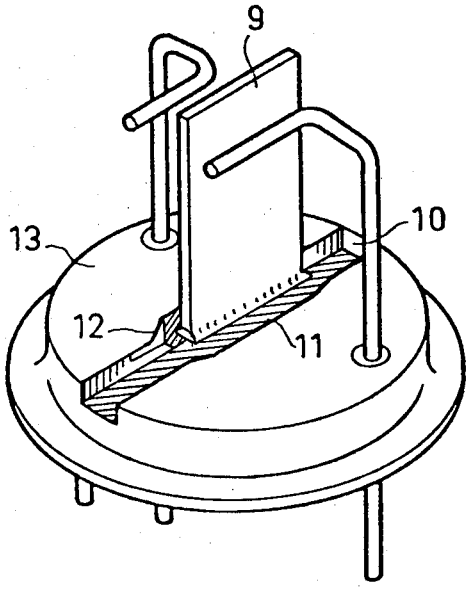
FIG. 6

DEVICE FOR ARTICULATING A MOVING BLADE PIVOTING ON ITS BASE AND A SWITCH WHICH COMPRISES SUCH A DEVICE

BACKGROUND OF THE INVENTION

The present invention relates to a device for articulating a plate or blade, which moves in an angular manner and pivots on its support. An example of such an articulation occurs, inter alia, in switches having wetted contacts and which are magnetically controlled.

The invention will be described in a specific manner with respect to the case of an electrical switch, without this constituting a limitation of the inventive scope.

Switches having contacts wetted by a conductive liquid, generally in the form of mercury of an amalgam are commonly known in the art as mercury wetted switches. In its best known form, such switches comprise a system of connected metal blades, whereof at least one has a certain flexibility, sealed into a glass envelope into which has been introduced an adequate quantity of mercury for wetting the blades. The main advantage of such switches is to offer a very good electrical contact without any deterioration to the contacting surfaces, because the latter are wetted by mercury, which regenerates the surfaces of the blades. However, when such switches use glass envelopes they have a certain number of disadvantages. Thus, in order to obtain an adequate flexibility of the moving blade, the latter must have a certain length linked with a certain thinness, so that the resulting device is relatively long, e.g. 2 cm. This is contrary to the present tendency towards miniaturisation made necessary by the increasing complexity of electronic systems, such as, for example, telephone exchanges or professional equipment.

In order to meet the demands of industry, mercury wetted switches must have small dimensions, a sensitivity to low currents so that they can be controlled, for example, by integrated circuits, a lack of sensitivity to vibrations included in all equipment acceptance testing standards and for cost reasons the need for a minimum of mechanical adjustments and settings, which increases their reliability because the fewer the adjustments and settings, the fewer the possible causes of misadjustments.

BRIEF SUMMARY OF THE INVENTION

The invention provides a solution to the double problem of size and sensitivity of mercury wetted switches by proposing a novel means for articulating the moving blade. According to the invention, the articulation of the moving blade, which was previously obtained either by an element of the blade having flexibility or by a mechanical articulation, which enabled dimensions to be reduced, but caused problems in connection with the electrical contact and jamming, is provided by a pivot pin which floats on a small quantity of mercury kept in a cavity, whose dimensions are adequate to keep the mercury in place by capillarity and also secure the pin, whilst preventing mechanical jamming.

More specifically, the invention relates to a device for articulating a moving blade, pivoting on its base with an angular movement, wherein the moving blade is integral with a float floating on a liquid contained in a cavity in which it is held by capillarity and which is made in the base, the nature of the float material and its dimensions being such that the hydrostatic buoyancy exerted by the liquid is equal to or exceeds the weight of the mobile assembly constituted by the float, the moving blade and the liquid film wetting the moving blade.

BRIEF DESCRIPTION OF THE DRAWINGS

The invention is described in greater detail hereinafter relative to non-limitative embodiments and the attached drawings, wherein show:

FIG. 1 an example of a switch with moving blades according to the prior art.

FIG. 2 the diagram of the articulation according to the invention.

FIG. 6 the diagram of the articulation similar to FIG. 2 except that metal member 10 has a length equal to the width of the moving blade.

DETAILED DESCRIPTION OF THE PREFERRED EMBODIMENTS

Figure 3:
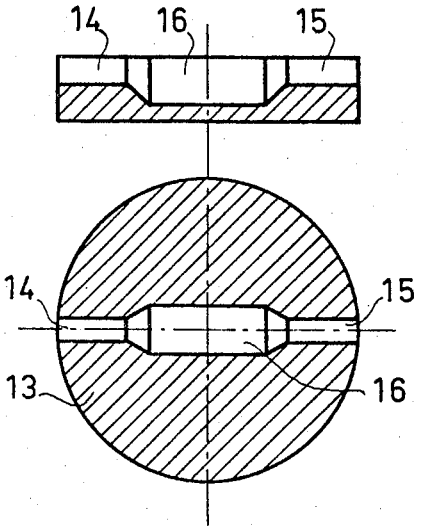
FIG. 3 is a plan view and an elevation of the cavity used for the articulation according to the invention.

FIG. 1 shows an example of a switch with moving blades according to the prior art, forming the subject matter of a patent application of the present Applicant Company.

In this type of switch, a metal socket or base 1 is traversed by two pins 2, 3 sealed by means of glass beads, said two pins 2, 3 constituting the break and make contacts and are curved in such a way as to ensure a good contact with a blade 4 located between them. Blade 4 is made from a ferromagnetic material and at one of its ends is articulated about a liquid hinge 5 constituted by a certain quantity of mercury which wets blade 4 as well as two parallel metal pins 6, 7 spaced by a distance which very slightly exceeds the thickness of the blade. The assembly formed by blade 4, pins 6, 7 and contacts 2, 3 are wetted by mercury. The external connections are provided by the pins 2, 3 which pass through the base, as well as by a third pin which is also called 1 in the drawing because it is in electrical contact with base 1. This type of relay is completed by a small polarization magnet 8, a cover, which is not shown so as to permit the interior of the relay to be seen, and a control coil, which is also not shown and is placed beneath the base between the output connections 1, 2 and 3.

This mercury wetted switch represents an advance compared with known switches and its operation is fully satisfactory. However, it requires a certain precision machining so as to prevent any mechanical seizing or gripping of the plate between the two pins 6 and 7 ensuring its liquid hinge. Thus, the liquid hinge must be sufficiently well regulated to ensure that the mercury provides a bridging contact between pins 6, 7 and blade 4 and so that the latter is held in the hinge without escaping therefrom during vibrations, however, this regulation must not prejudice the sensitivity of the switch.

FIG. 2 shows the articulation means for the moving plate or blade as proposed by the present invention.

According to the invention, moving blade 9 is integral with a member 10 to which it is connected by welding, brazing or any other appropriate means such as a T-shaped cut and a moving back of the metal. Member 10 does not function as a pivot pin for which it does not have the machining accuracy or the corresponding bearings. Instead, it functions as a float for supporting the moving blade 9 and for permitting its angular displacement. Thus, metal member 10 floats on a mercury bath 11, held in place by a cavity 12 made in base 13. Float 10 is elongated because it is joined by its edge to a blade. However, it can have the same length as the blade width or a greater length. Its cross-sectional shape is unimportant, but if its length exceeds the blade width, it is of interest that the projecting portions are cylindrical to prevent mechanical blocking. In FIG. 2, base 13 has the shape of the bases of encapsulating boxes for discrete semiconductors of the signal transistor type, but it can have any other suitable shape for the construction of a switch.

The moving assembly constituted by blade 9 and float 10 is introduced into cavity 12 and floats with neutral equilibrium in the conductive liquid filling the said cavity.

To obtain this result, it is merely necessary for the weight of the moving assembly to be equal to the hydrostatic buoyancy exerted by the liquid on the float. This means that the material from which the float is made must have a lower density than that of the liquid in which it is immersed, due to the additional weight imposed by the moving blade which is outside the liquid.

The following calculation carried out on a specific switch shows that blade 9 does indeed float in the conductive liquid as a result of its float 10. The conductive liquid ensuring that the mobile assembly floats is mercury of density 13.6 g/cm$^3$. The moving blade is made from 78% iron-nickel of density 8.60 g/cm$^3$ and its dimensions are $0.97\times0.186\times3.9$ mm. The blade is covered with a 0.05 mm thick mercury film. The float is made from 50% iron-nickel, of density 8.25 g/cm$^3$, diameter 0.61 mm and length 7.5 mm. The weight of the mobile assembly is 18 mg for the float, 6 mg for the blade, plugs 5 mg for the mercury on the blade surface. Thus, the total weight is 29 mg, whilst the hydrostatic bouyancy exerted on the float is 29.6 mg. Thus, the weight of the blade is less than the hydrostatic bouyancy exerted by the mercury and the mobile assembly floats in the mercury.

The volume of cavity 12 is small and it is noteworthy that provided that the cavity surfaces and the mobile assembly surfaces, together with the stop members are wetted by the mercury, the latter remains in place in all positions relative to the vertical of the location as a result of the surface tension forces. The hydrostatic buoyancy is exerted on the float on a permanent basis to cancel out the weight of a mobile assembly.

The aforementioned wettability condition is easily satisfied if the base 13 in which the cavity 12 is machined is made from metal, it then merely being necessary to treat the surfaces of cavity 12 so as to make them wettable. Within the outer ring, which is made from metal so as to permit sealing by electric welding base 13 can also comprise a central flat coil made from a ceramic material. It is then merely necessary to metallize by means of a brush or any other adequate process the walls of cavity 12 so as to make them wettable by mercury.

FIG. 3 shows the cavity 12 in plan view and sectional view in the central part of base 13. In FIG. 2, the cavity is shown as having a substantially square cross-section at its ends. This is in fact only an exemplified embodiment. The important point is that the two walls of the cavity leave an adequate clearance between them and the float to enable the latter to be effectively surrounded by the liquid and is not jammed. The bottom of the cavity can either be flat or curved, e.g. semi-cylindrical. Cavity 12 can be machined by stripping away filings from a metal base 13 or can be stamped from metal. However, if base 13 is made from a ceramic material, cavity 12 can be obtained by fritting during the production of the base.

According to a preferred embodiment, cavity 12 is made in three parts, namely a central part and two parts at the ends of the float. The two end parts 14, 15 have the same width as the float diameter, plus a certain clearance, such as for example a third of the float diameter, so as to ensure an adequate guidance of the mobile assembly without any risk of jamming. The depth of these ends 14, 15 must at least be equal to the float diameter. Thus, parts 14 and 15 of cavity 12 constitute bearings for the float, although the term bearing is incorrect because it presupposes a greater adjustment precision. However, these end parts 14, 15 can be considered as guide cages for preventing seizure or jamming of the mobile assembly, although said cages do not require a high machining precision.

The central part 16 constitutes the mercury reserve in cavity 12. For this purpose, its width is significantly increased compared with that of the end parts 14, 15 and is, for example, approximately 50% wider than the diameter of the mobile member. Its depth is also increased as a consequence.

When the mobile member is fitted in cavity 12 and the latter is filled with mercury which, together with its amalgams has hitherto been the most commonly used conductive liquid, the tensile forces within the mercury, as well as its wettability with respect to the cavity walls in its end parts 14, 15 and the wettability of the mercury on float 10 prevent any outward leakage of mercury, so that it serves no useful purpose to close cavity 12 outside base 13.

Figure 4:
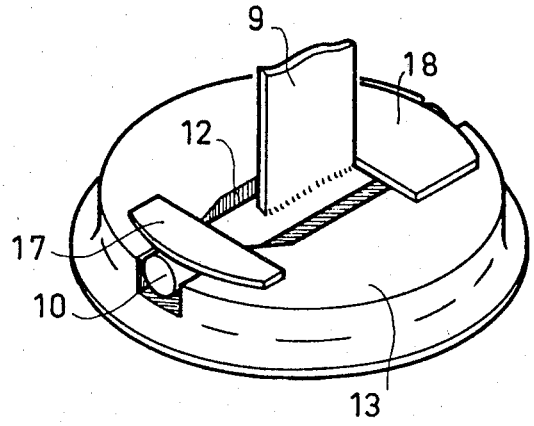
FIG. 4 two devices for blocking the articulation according to the invention.

FIG. 4 shows two examples of means for fixing the mobile assembly to the switch base.

As the mobile assembly is articulated by a metal cylinder floating on a mercury bath, which ensures the operation of the mercury wetted switch, so that in the case of vibrations or shocks, it is necessary to provide means for preventing the float leaving the cavity 12. To this end, the invention either provides a narrow metal plate like that shown at 17, which only covers the outer parts 14, 15 of cavity 12, or a wide metal plate like that shown at 18, which covers that part of the cavity 12 located between the mobile blade 9 and the periphery of base 13.

The assembly formed by the two narrow plates 17 or the two wide plates 18 can be replaced by a single U-shaped part, whose two branches constitute the two plates.

Other equivalent means can be used, but a narrow plate like 17 has the advantage of ensuring friction on float 10 only along a short generatrix, i.e. friction is limited. However, a wider plate like that shown at 18 ensures a more complete closure of the cavity, which is always a useful precaution for ensuring that mercury does not escape from the cavity as a result of violent shocks.

Figure 5:
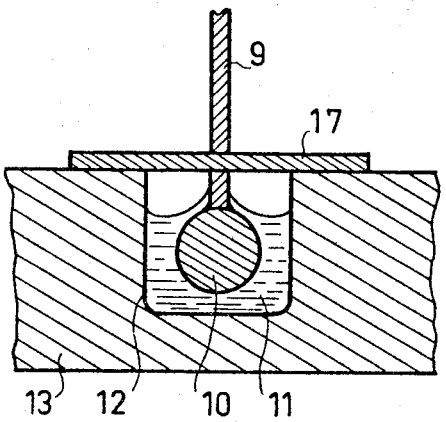
FIG. 5 an elevation of the articulation and the float in mercury.

FIG. 5 shows the floating articulation of the mobile blade, viewed from one end of the device.

The mobile blade 9 is welded to its float 10, shown in end view, and floats on a small quantity of mercury 11 within cavity 12 made in the socket or base 13 of a mercury wetted switch. A metal member 17 prevents the blade and float from escaping from this cavity.

FIG. 5 is intended to illustrate that the float 10 is in a liquid bath and that the spacing of the cavity walls makes it impossible to confuse this articulation device with a mechanical spindle held in two bearings.

The described embodiment is based on the case where the conductive liquid is mercury, because mercury and its alloys are the most widely used liquids at present. However, this type of mobile articulation and its construction can also be used when the conductive liquid is not mercury and this also falls within the scope of the invention. In particular, if the conductive liquid is e.g. NaK, a eutectic between sodium and potassium melting at 5° C. for the operation of the articulation device is merely necessary to adapt the densities and dimensions of the float to the density of the conductive liquid.

The wetted contact relay completing the articulation device described also has work and rest electrodes traversing base 13 ensuring on the one side of the base the external contacts and on its other side the make and break contacts with the moving blade 9. Furthermore, the common contact on blade 9 is made directly on base 13 if the latter is made from metal or by means of a silk screen printed metallization if base 13 is made from a ceramic or insulating material. In accordance with the art, the relay is also completed by a polarizing magnet which preferentially orients the moving blade towards one of the two contacts, as well as by external control means either in the form of a coil or a mobile magnet, whilst it is closed by a hermetically sealed cover on the base. Other features and advantages of the articulation according to the invention will be apparent to the Expert from the following claims.

What is claimed is:

1. A device for the articulation of a moving blade, whose plane pivots in an angular manner on its base, wherein the moving blade is fixed to a float floating on a liquid contained in a cavity in which it is held by capillarity and which is made in the base, the nature of the float material and its dimensions being such that the hydrostatic buoyancy which is exerted by the liquid is equal to or exceeds the weight of the mobile assembly constituted by the float, the moving blade and the liquid film wetting the said blade, the equilibrium of the force ensuring that the articulation operates independently of its position in space.

2. An articulation device according to claim 1, wherein the liquid is an electricity-conducting liquid which, by wetting the surface of the moving blade makes it conduct electricity, so that it is possible to open or close an electric contact between the moving blade and at least one fixed electrode.

3. An articulation device according to claim 2, wherein the cavity is made from a liquid-wettable material.

4. An articulation device according to claim 1, wherein the float comprises a metal member, whose length exceeds the width of the moving blade and whereof at least those parts outside the blade are cylindrical.

5. An articulation device according to claim 1, wherein the float comprises a metal member, whose length is equal to the width of the moving blade.

6. An articulation device according to claim 1, wherein the cavity containing the liquid on the one hand comprises the two outer parts, whose width exceeds the diameter of the float and whose depth is at least equal to said diameter, said outer parts serving as guide cages for the float and on the other hand a central part whose width is equal to one and a half times the float diameter and has an identical depth, said central part serving as a liquid reservoir.

7. An articulation device according to claim 1, wherein the cavity is made from a liquid-wettable material.

8. An articulation device according to claim 1, wherein the mobile member, blade and float is prevented from escaping from the cavity due to shocks or vibrations by means of at least one plate fixed relatively to the base and forming a bridge over the float, at least in the outer parts of the said cavity.

9. An articulation device according to claim 1, wherein the liquid on which the mobile member, blade and float floats is constituted by mercury or a mercury amalgam.

10. An articulation device according to claim 1, wherein the liquid on which the mobile means, blade and float floats is constituted by a eutectic or sodium and potassium liquid at +5° C.

11. A switch having wetted contacts and which is magnetically controlled, wherein it comprises a moving blade articulated according to any one of the claims 1 or 3.

* * * * *